US005929696A

United States Patent [19]

Lim et al.

[11] Patent Number: 5,929,696

[45] Date of Patent: Jul. 27, 1999

[54] CIRCUIT FOR CONVERTING INTERNAL VOLTAGE OF SEMICONDUCTOR DEVICE

[75] Inventors: Jong-Hyoung Lim; Jae-hoon Joo; Sang-seok Kang; Jin-seok Lee, all of Suwon, Rep. of Korea

[73] Assignee: Samsung Electronics, Co., Ltd., Suwon, Rep. of Korea

[21] Appl. No.: 08/953,052

[22] Filed: Oct. 17, 1997

[30] Foreign Application Priority Data

Oct. 18, 1996 [KR] Rep. of Korea ..... 96-46854

[51] Int. Cl.[6] ..... G05F 1/10

[52] U.S. Cl. ..... 327/540; 327/541; 323/316

[58] Field of Search ..... 327/540, 541; 323/316

[56] References Cited

U.S. PATENT DOCUMENTS

| | | | |
|---|---|---|---|
| 4,127,783 | 11/1978 | Alaspa | 327/538 |
| 4,570,115 | 2/1986 | Misawa et al. | 323/313 |
| 5,124,631 | 6/1992 | Terashima | 323/313 |
| 5,485,117 | 1/1996 | Furumochi | 327/538 |
| 5,493,205 | 2/1996 | Gorecki | 323/315 |
| 5,563,553 | 10/1996 | Jackson | 331/57 |
| 5,689,460 | 11/1997 | Ooishi | 365/189.07 |

*Primary Examiner*—Terry D. Cunningham
*Assistant Examiner*—Maria Hasonzadah
*Attorney, Agent, or Firm*—Marger Johnson & McCollom, P.C.

[57] ABSTRACT

An internal voltage conversion circuit for a DRAM wherein a voltage level of an internal power supply is regulated by an external signal applied to the DRAM pins after packaging to perform reliability tests. The internal voltage conversion circuit includes a test mode signal generator, for generating a test mode signal by combining first control signals applied externally of the semiconductor device, and a switching signal generator, for generating first and second switching signals according to second control signals applied externally of the DRAM when the test mode signal is active. First and second switching resistor portions connected in series between the internal power supply port and a ground potential are switched by the first and second switching signals, respectively, so that their resistance values are changed. The resistor portions are in a feedback path connected to one input of a comparator. The other input is connected to a reference cell. The internal voltage supply varies responsive to changes in resistance values.

12 Claims, 8 Drawing Sheets

CIRCUIT FOR CONVERTING INTERNAL VOLTAGE OF SEMICONDUCTOR DEVICE

BACKGROUND OF THE INVENTION

1. Field of the Invention

The present invention relates to a semiconductor device, and more particularly, to a circuit for converting an internal voltage in a semiconductor device.

2. Description of the Related Art

In a semiconductor device, one method for converting an internal voltage comprises dropping an external power supply voltage to reduce power consumption. This facilitates applying an increased internal voltage to a circuit element such as a transistor during, e.g., a testing mode. As integration has increased, circuit size is reduced thus requiring smaller voltages for the smaller circuit components. However, because a manufacturer cannot freely lower an external power supply, it is necessary to generate an internal power supply voltage to provide the required lower voltage. FIGS. 1 and 2 illustrate conventional internal voltage conversion circuits in a semiconductor device.

In FIG. 1, a comparator 110 compares a predetermined reference voltage VREF with a feedback voltage and applies a compared result to a gate of a pull-up transistor 120. The drain of the pull-up transistor 120 comprises an internal power supply terminal which supplies an internal power supply voltage VINT. The voltage on the internal power supply terminal is divided by resistors R1 and R2 and fed back to an input port of the comparator 110. Here, the size of the feedback voltage applied to the comparator 10 is calculated in the following equation 1.

$$Vfeedback = VINT\frac{R2}{R1 + R2} \tag{1}$$

In the internal voltage conversion circuit shown in FIG. 2, a comparator 130 compares a reference voltage VREF with a feedback voltage. A pull-up transistor 140 is switched according to the output of the comparator 130. Accordingly, the comparator 130, compares the reference voltage VREF with a feedback voltage, $V_{feedback}$ in equation 2, which is a function of V1, the voltage at the drain of transistor 140. The voltage V 1 is driven by a driving portion comprised of a comparator 150 and a pull-up transistor 160. The output of the circuit of FIG. 2 is an internal power supply voltage VINT.

$$Vfeedback = V1\frac{R4}{R3 + R4} \tag{2}$$

However, the foregoing conventional internal voltage circuits for a semiconductor device always provides a power supply voltage of a constant level internally. In particular, after packaging the memory in a plastic package, the level of the internal supply power supply is impossible to control. Therefore, semiconductor products undergo only a function test to detect various product inferiorities, which limits the type of screening for defects in the memories. These products could be more fully tested if the internal supply could be varied after the products are packaged.

SUMMARY OF THE INVENTION

Accordingly, it is an object of the present invention to provide an internal voltage conversion circuit for a semiconductor device which has an output voltage that can be adjusted responsive to external controls.

It is another object of the present invention to provide an internal voltage conversion circuit for a semiconductor device which can improve testing for defects by testing with variously-adjusted internal power supply levels as part of the testing process.

To accomplish the above objects, there is provided an internal voltage conversion circuit in a semiconductor device, comprising an internal power supply port through which an internal power supply voltage is output; a comparator having a pair of input terminals and an output terminal; a feedback line connected to one of said input terminals; a reference voltage generator contained within the semiconductor device and having a reference voltage output terminal connected to the other of said comparator input terminals; a transistor having a first port connected to a power supply voltage external to the semiconductor device, a control port connected to the output terminal of the comparator, and a second port; a test mode signal generator for generating a test mode signal responsive to a first signal applied from the outside of the semiconductor device; a switching signal generator for generating first and second switching signals responsive to second control signals applied from the outside of the semiconductor device when the test mode signal is active; and first and second switching resistor portions connected in series between said second port and a ground voltage, and switched by the first and second switching signals, respectively, so that their resistance values are changed, said feedback line being connected between the first and second switching resistor portions.

BRIEF DESCRIPTION OF THE DRAWING(S)

The above objects and advantages of the present invention will becomes more apparent by describing in detail a preferred embodiment thereof with reference to the attached drawings in which.

DETAILED DESCRIPTION OF THE INVENTION

Figure 1:
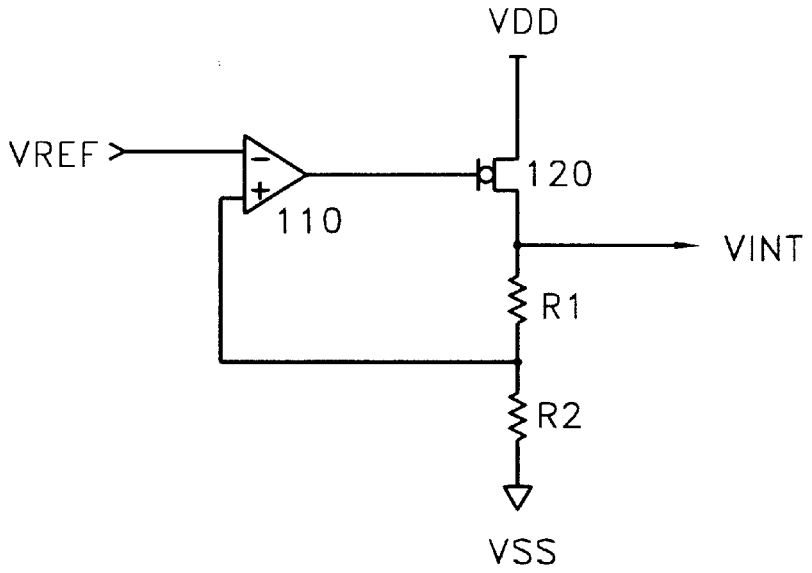
FIG. 1 (PRIOR ART)
FIG. 1 is a circuit diagram showing an example of a conventional internal voltage conversion circuit for a semiconductor device.
Figure 2:
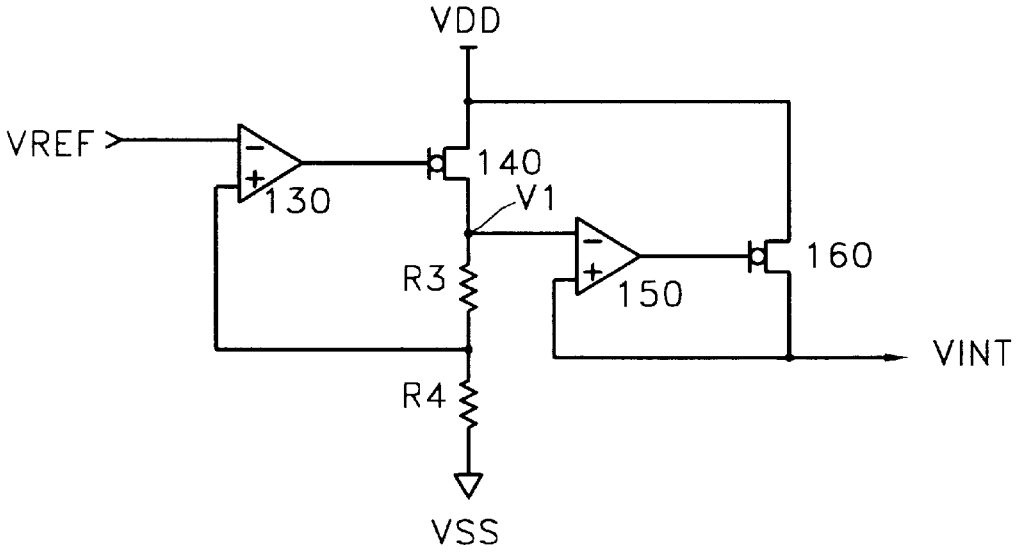
FIG. 2 (PRIOR ART)
FIG. 2 is a circuit diagram showing another example of a conventional internal voltage conversion circuit for a semiconductor device.
Figure 3:
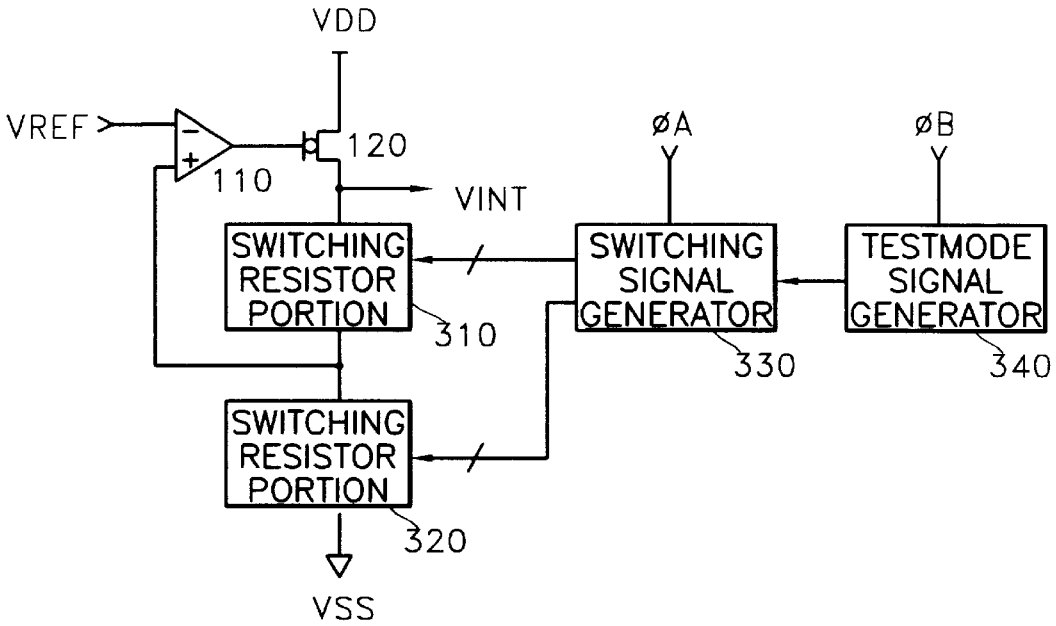
FIG. 3 is a block circuit diagram of an internal voltage conversion circuit for a semiconductor device according to an embodiment of the present invention.

Referring to FIG. 3, an internal voltage conversion circuit includes a comparator 110, a pull-up transistor 120, switching resistor portions 310 and 320, a switching signal generator 330 and a test mode signal generator 340. A reference voltage VREF applied to the comparator 110 is a voltage which is generated inside of a semiconductor device. The pull-up transistor 120 is connected at one port to an external power supply voltage VDD which is supplied from power supply external to the semiconductor device. The output of the comparator 110 is applied to a control port of the pull-up transistor 120. The other port thereof is connected to an internal power supply port. The test mode signal generator 340 generates a test mode signal PFTE on the basis of first control signals ΦB applied to terminals on the semiconductor device from a source external to the semiconductor device.

The switching signal generator 330 generates switching signals according to second control signals ΦA applied to terminals on the semiconductor device from a source external to the semiconductor device when the test mode signal PFTE is active and maintains the previously-generated switching signal when the test mode signal PFTE is inactive.

The switching resistor portions 310 and 320 are switched according to the switching signals output from the switching signal generator 330 so that their resistance values are changed.

In the circuit of FIG. 3, and with reference to equation 3, if the resistance of the switching resistance portion 310 is indicated by RX and the resistance of the switching resistance portion 320 is indicated by RY, the size of the voltage fed back to the comparator 110 is as follows:

$$Vfeedback = VINT\frac{RY}{RX + RY} \tag{3}$$

As shown above, when the feedback voltage becomes lower than the reference voltage VREF, the output of the comparator 110 becomes a "low" level, and the pull-up transistor 120 is thus turned on so that a voltage level of its internal power supply port is increased. On the contrary, when the feedback voltage becomes higher than the reference voltage VREF, an output of the comparator 110 becomes a "high" level, and the pull-up transistor 120 is thus turned off so that the voltage level of its internal power supply port is decreased. Thus, the level of the internal power supply port is regulated to a level described in the following equation 4.

$$VINT = VREF\left(1 + \frac{RX}{RY}\right) \tag{4}$$

As can be seen from the foregoing equation 4, the level of the internal power supply voltage VINT can be controlled by regulating the resistance values RX and RY of the switching resistor portions 310 and 320.

Figure 4:
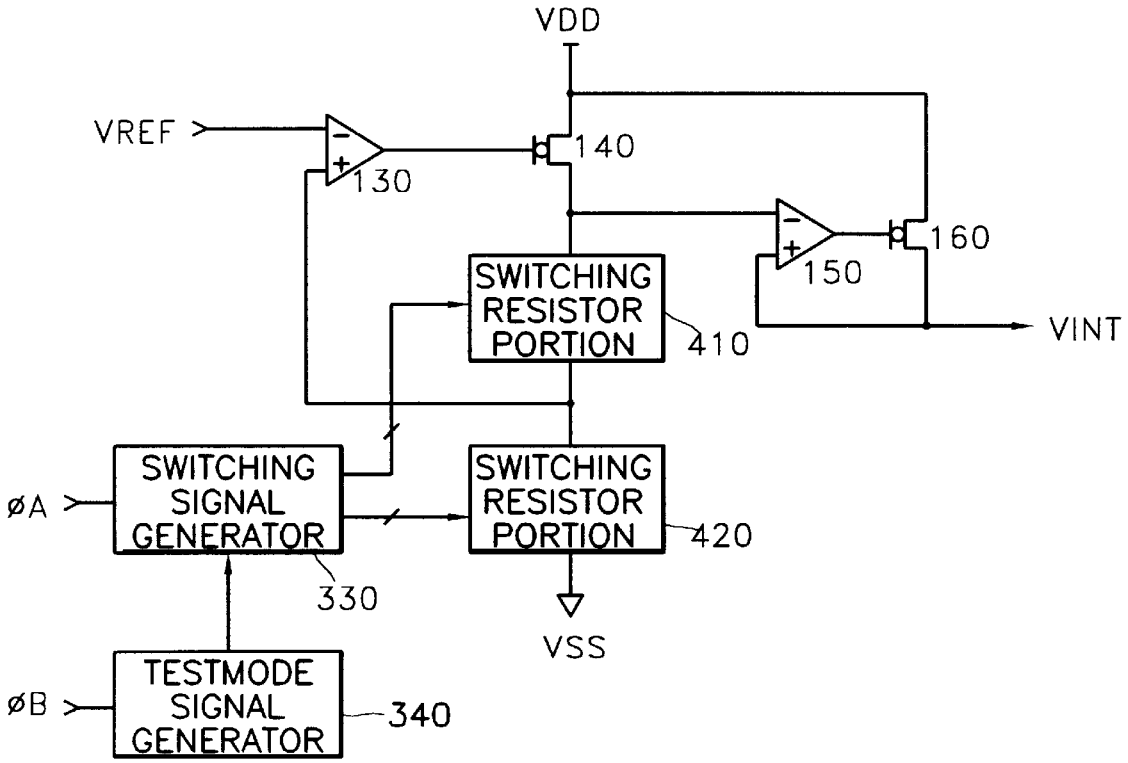
FIG. 4 is a block circuit diagram of an internal voltage conversion circuit for a semiconductor device according to another embodiment of the present invention.

Referring to FIG. 4, an internal voltage conversion circuit for a semiconductor device according to another embodiment of the present invention includes a comparator 130, a pull-up transistor 140, switching resistor portions 410 and 420, a switching signal generator 330, a test mode signal generator 340, a comparator 150 and a pull-up transistor 160. The comparator 130 compares a feedback voltage applied to a feedback line with a predetermined reference voltage VREF generated inside the semiconductor device. The output of comparator 130 is a "high" level when the feedback voltage is greater than the reference voltage VREF and is a "low" level when the feedback voltage is less than the reference voltage VREF. The test mode signal generator 340 and switching signal generator 330 are the same as those shown in FIG. 3, the switching resistor portion 410 is the same as the switching resistor portion 310, and the switching resistor portion 420 is the same as the switching resistor portion 320. The comparator 150 compares the internal power supply voltage VINT with a voltage at the drain port of the pull-up transistor 140. The output of comparator 150 is applied to the gate of the pull-up transistor 160.

In the internal voltage conversion circuit of FIG. 4, if the resistances of the switching resistance portions 410 and 420 are RV and RW, respectively, the level of the internal power supply voltage is described in the following equation 5.

$$VINT = VREF\left(1 + \frac{RV}{RW}\right) \tag{5}$$

Figure 5:
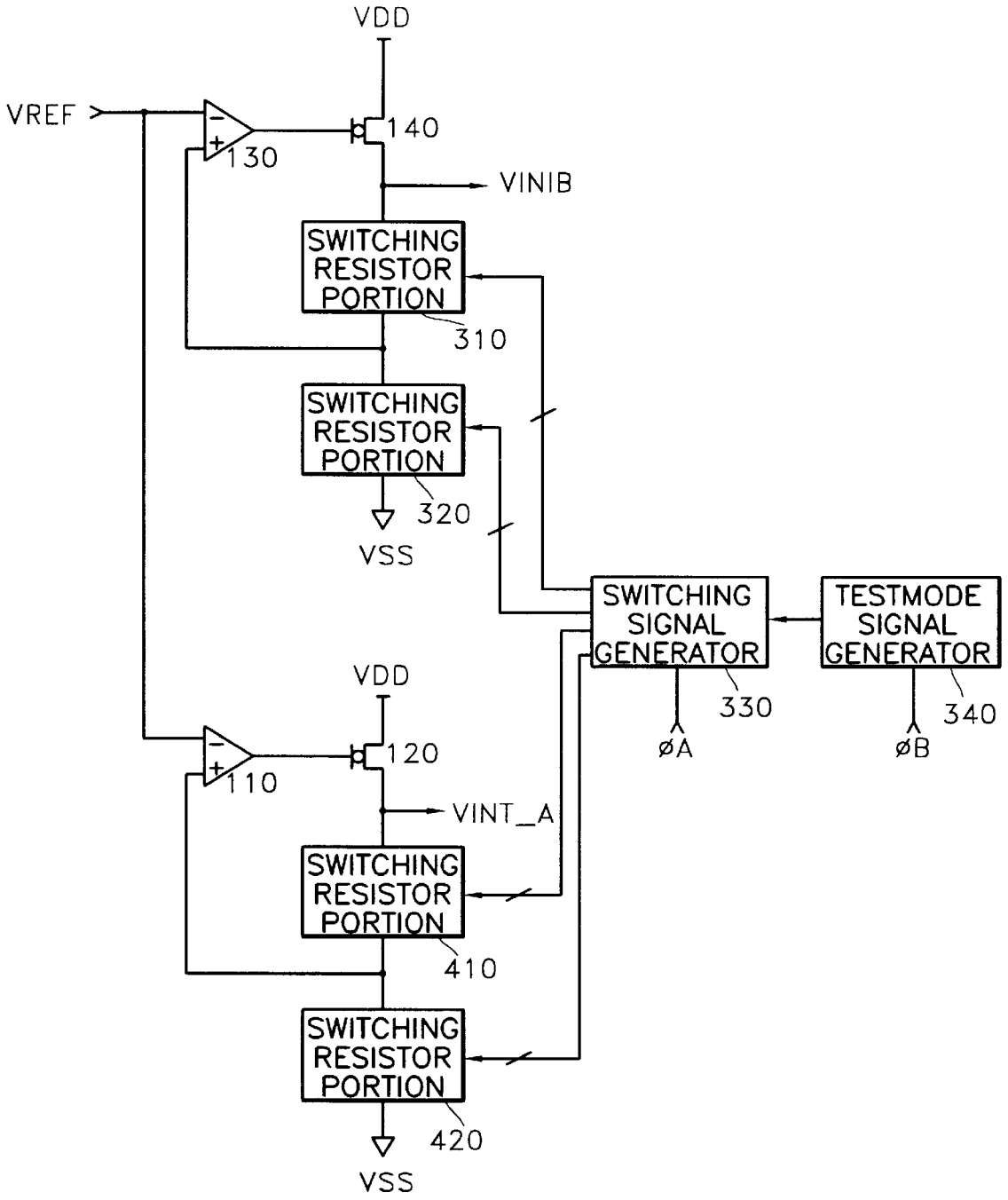
FIG. 5 is a block circuit diagram of an internal voltage conversion circuit for a semiconductor device according to still another embodiment of the present invention.

FIG. 5 is a block circuit diagram of an internal voltage conversion circuit for a semiconductor device according to still another embodiment of the present invention. In particular, FIG. 5 illustrates a pair of internal power supplies which provide different internal voltages for a peripheral circuit and for a memory cell array in a semiconductor memory device.

Referring to FIG. 5, the internal voltage conversion circuit includes comparators 110 and 130, pull-up transistors 120 and 140, switching resistor portions 310, 320, 410 and 420, a switching signal generator 330 and a test mode signal generator 340. The drain of the pull-up transistor 140 is connected to a peripheral circuit power supply output port at which an internal power supply voltage VINIB for driving the peripheral circuit in the semiconductor memory device is output. The drain of the pull-up transistor 120 is connected to an array power supply output port at which an internal power supply voltage VINT_A for driving the cell array in the semiconductor memory device is supplied.

In the internal voltage conversion circuit of FIG. 5, if the resistance values of the switching resistor portions 310, 320, 410 and 420 are RX, RY, RV and RW, respectively, the voltage level at the peripheral circuit power supply output port can be shown as in the above equation 5, and the voltage level at the array power supply output port can be shown as in the above equation 4.

Figure 6:
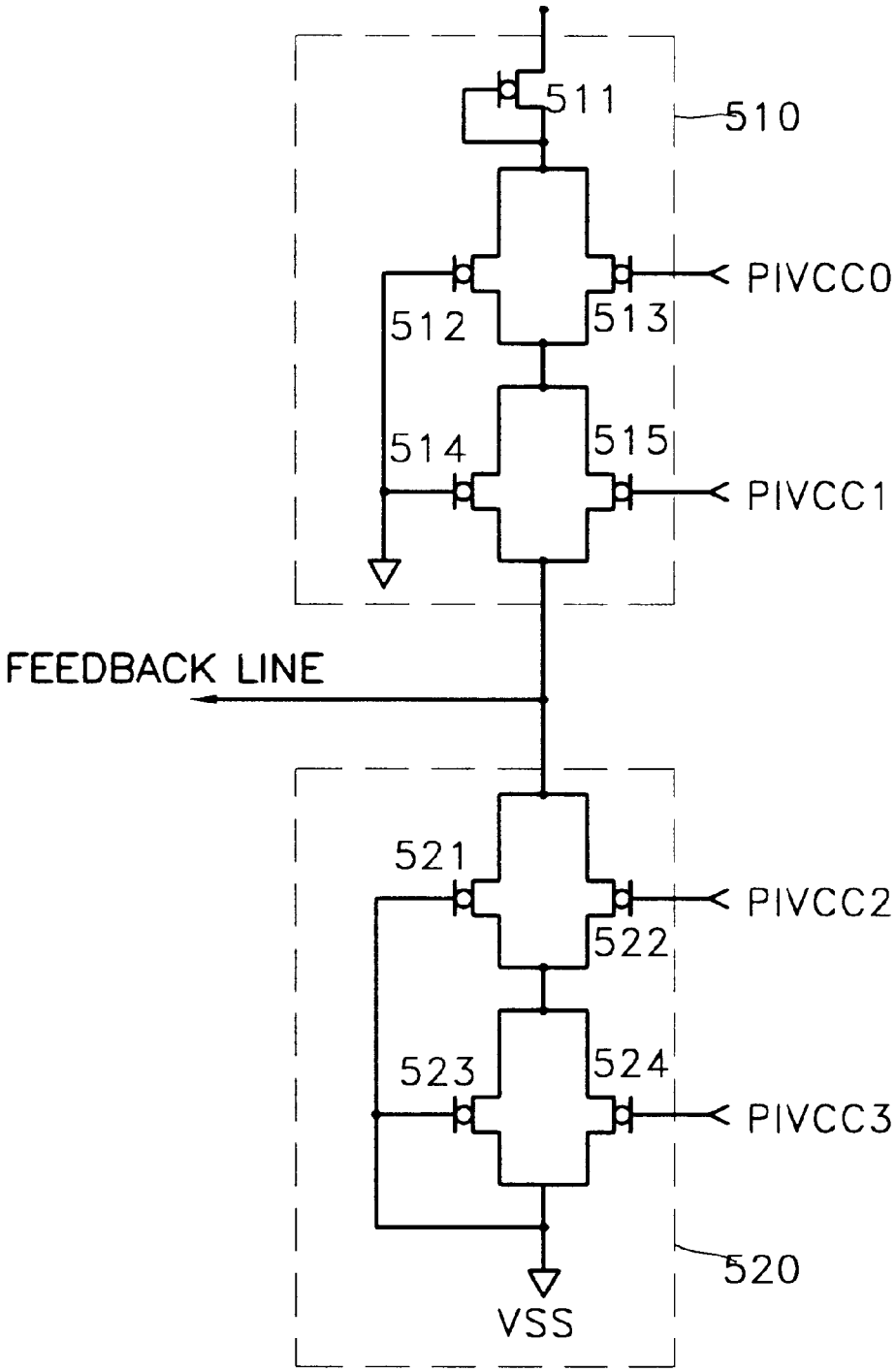
FIG. 6 is a circuit diagram of switching resistor portions shown in FIGS. 3 to 5.

FIG. 6 is a detailed circuit diagram of the switching resistor portions shown in FIGS. 3 to 5, where a block 510 is a detailed circuit diagram of the switching resistor portion 310 or 410 and a block 520 is a detailed circuit diagram of the switching resistor portion 320 or 420.

Referring to FIG. 6, a diode is constituted by commonly connecting the drain of the PMOS transistor 511 to the gate thereof. The source of a PMOS transistor 512 is connected to the drain of the PMOS transistor 511, and the gate thereof is grounded. The source of a PMOS transistor 513 is connected to the drain of the PMOS transistor 511, and a switching signal PIVCC0 is applied to the gate of the PMOS transistor 513. The source of a PMOS transistor 514 is commonly connected to the drains of the PMOS transistors 512 and 513, its gate is grounded, and its drain is connected to a feedback line. The source of a PMOS transistor 515 is commonly connected to the drains of the PMOS transistors 512 and 513, a switching signal PIVCC1 is applied to its gate, and its drain is connected to the feedback line. A resistance of the block 510 is changed by the switching signals PIVCC0 and PIVCC1, which will be described in detail as follows: In the following equations, the resistance of PMOS transistor 511 is RPL, the resistance of a PMOS transistor that is turned on is called RPON, and the resistance of a PMOS transistor that is turned off is called RPOFF. The resistance value R510 of the block 510 is described in equations 6 to 9, depending on the state of the switching signals PIVCC0 and PIVCC1.

$$R510 = RPL + (RPON \| RPON) + (RPON \| RPON) \tag{6}$$

$$= RPL + \frac{RPON}{2} + \frac{RPON}{2} = RPL + RPON$$

where PIVCC0 equals 0 and PIVCC1 equals 0.

$$R510 = RPL + (RPON \| RPON) + (RPON \| RPOFF) \tag{7}$$

$$= RPL + \frac{RPON}{2} + \frac{RPON\ RPOFF}{RPON + RPOFF}$$

where PIVCC0 equals 0 and PIVCC1 equals 1.

$$R510 = RPL + (RPON \| RPOFF) + (RPON \| RPON) \tag{8}$$

$$= RPL + \frac{RPON\ RPOFF}{RPON + RPOFF} + \frac{RPON}{2}$$

where PIVCC0 equals 1 and PIVCC1 equals 0.

$$R510 = RPL + (RPON \| RPOFF) + (RPON \| RPOFF) \tag{9}$$

$$= RPL + \frac{RPON\ RPOFF}{RPON + RPOFF} + \frac{RPON\ RPOFF}{RPON + RPOFF}$$

where PIVCC0 equals 1 and PIVCC1 equals 1.

In general, the resistance of a turned-off transistor is greater than that of a turned-on PMOS transistor. Accordingly, the resistance value of the block 510 can be varied by changing the switching signals PIVCC0 and PIVCC1.

In FIG. 6, the block 520 is a detailed circuit diagram of the switching resistor portion 320 or 420 shown in FIGS. 3 to 5, which includes four PMOS transistors 521, 522, 523 and 524. The gates of the PMOS transistors 521 and 523 are connected to ground potential so that the PMOS transistors 521 and 523 are always turned on. Meanwhile, the PMOS transistors 522 and 524 receive switching signals PIVCC2 and PIVCC3 through their gates. Thus, a resistance value R520 of the block 520 is varied according to the switching signals PIVCC2 and PIVCC3, and represented in the following equations 10 to 13.

$$R520 = (RPON \| RPON) + (RPON \| RPON) \tag{10}$$

$$= \frac{RPON}{2} + \frac{RPON}{2} = RPON$$

where PIVCC2 equals 0 and PIVCC3 equals 0.

$$R520 = (RPON \| RPON) + (RPON \| RPOFF) \tag{11}$$

$$= \frac{RPON}{2} + \frac{RPON\ RPOFF}{RPON + RPOFF}$$

where PIVCC2 equals 0 and PIVCC3 equals 1.

$$R520 = (RPON \| RPOFF) + (RPON \| RPON) \tag{12}$$

$$= \frac{RPON\ RPOFF}{RPON + RPOFF} + \frac{RPON}{2}$$

where PIVCC2 equals 1 and PIVCC3 equals 0.

$$R520 = (RPON \| RPOFF) + (RPON \| RPOFF) \tag{13}$$

$$= 2\frac{RPON\ RPOFF}{RPON + RPOFF}$$

where PIVCC2 equals 1 and PIVCC3 equals 1.

In FIG. 6, the switching resistor portions are realized using PMOS transistors. However, if a switching feature is provided and the resistance value is changed according to the switching feature, the use of different elements also enables the realization of the switching resistor portions. For example, NMOS transistors can be used for realizing the switching resistor portions.

Figure 7:
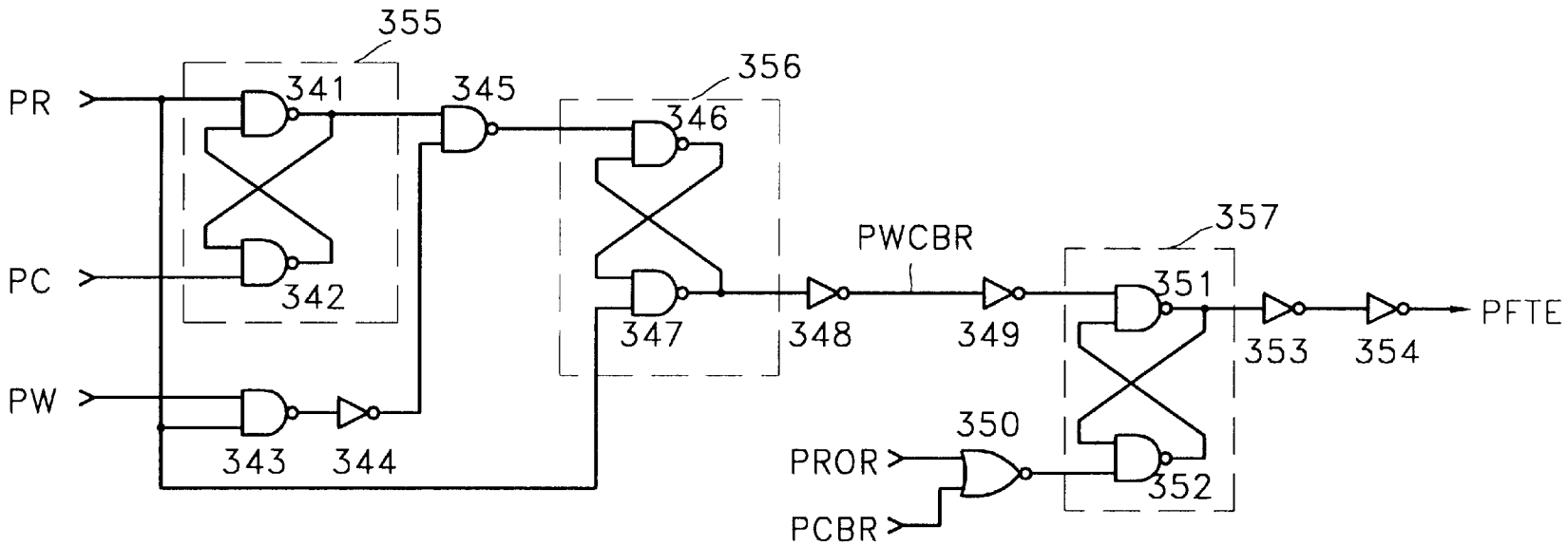
FIG. 7 is a circuit diagram of the test mode signal generator shown in FIGS. 3 to 5.

FIG. 7 is a detailed circuit diagram of the test mode signal generator shown in FIGS. 3 to 5. In particular, in a semiconductor memory device, the test mode signal generator generates a test mode signal PFTE responsive to first control signals (ΦB which are generated on the basis of a signal generated externally of the semiconductor memory device which is applied to terminals on the device. In FIG. 7, signals PR, PC, PW, PROR and PCBR are generated within a semiconductor dynamic random access memory (DRAM) incorporating the present invention on basis of signals applied from the outside of the DRAM, which will be described with reference to a timing diagram of FIG. 10. In typical reading and writing operations, a row address strobe (RAS) signal is initially activated, and, simultaneously, signals applied to address pins are input as row addresses. Then, a column address strobe (CAS) signal is activated, and, simultaneously, signals applied to address pins are input as column addresses. However, in order to perform a test for defective memory cells after the DRAM is fabricated, unlike normal reading and writing operations of the memory, a writing enable (WEB) signal is initially activated, and the column and row address strobe signals CASB and RASB are subsequently activated to set the semiconductor memory device to a test mode (WCBR mode).

Figure 10:
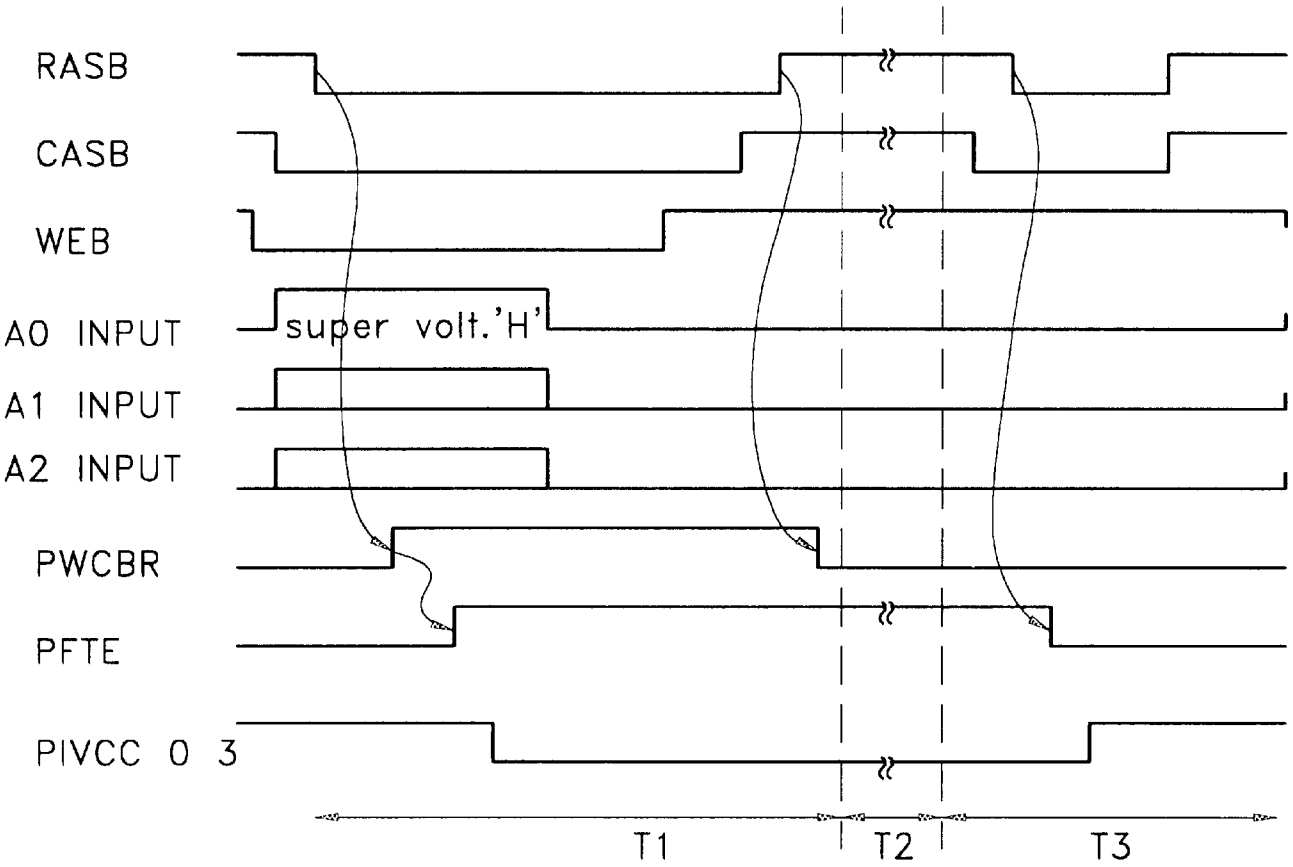
FIG. 10 is a timing diagram illustrating an operation of the internal voltage conversion circuit for a semiconductor device according to the present invention.

In FIG. 10, referring to a test mode setting period T1, after the writing enable signal (WEB), column address strobe signal (CASB) and row address strobe signal (RASB) are sequentially activated, a predetermined time passes. A PWCBR signal and a test mode signal PFTE are then sequentially activated thus setting a test mode. After the test mode signal PFFE is activated, switching signals PIVCC0, PIVCC1, PIVCC2 and PIVCC3 are generated and maintained for a test mode time T2.

Returning to FIG. 7, after the row address strobe signal (RASB) is activated, the PR signal, as a signal generated on the basis of the row address strobe signal (RASB), is activated to a high level after the lapse of a predetermined time. The PC signal which is generated on the basis of the column address strobe signal (CASB) after the column address strobe signal (CASB) is activated, is activated to a high level after the lapse of a predetermined time. The PW signal, after the writing enable signal (WEB) is activated, is activated after a lapse of a predetermined time. The PROR signal is enabled in a RASB ONLY REFRESH (ROR) mode, and the PCBR signal is enabled in a CASB BEFORE RASB (CBR) mode. That is, the PROR signal is activated when only the RASB is refreshed, and the PCBR signal is generated when the RASB is activated after the CASB is activated. In a flip-flop comprised of NAND gates 341 and 342, when the PR signal has a low level, the output is set to a high level. Also, when the PC signal has a low level, the output is reset to a low level. The PR and PW signals are applied to a NAND gate 343, the output of which is applied to an invertor 344. A NAND gate 345 performs a NAND-operation of the outputs of the flip-flop 355 and the invertor 344. A flip-flop 356 comprised of NAND gates 346 and 347 is set when the output of the NAND gate 345 has a low level, and reset when the PR signal has a low level. An invertor 348 inverts the output of the flip-flop 356 and outputs a PWCBR signal. Thus, the PWCBR signal, when the WEB, CASB and RASB are sequentially activated, is activated to a high level (see FIG. 10). An invertor 349 inverts the PWCBR signal. The PROR and PCBR signals are applied to a NOR gate 350. A flip-flop 357 comprised of NAND gates 351 and 352 is set and has a high level when the PWCBR signal has a high level, and reset and has a low level when one of the PROR and PCBR signals has a high level. Thus, when the column address strobe signal CASB is activated regardless of the writing enable signal WEB and the row address strobe signal RASB is then activated, the test mode signal PFTE is converted into an inactive state as can be seen in period T3 of FIG. 10. Again in FIG. 7, invertors 353 and 354 delay the output of the flip-flop 357 and output the test mode signal PFTE. According to the embodiment of the test mode signal generator 340 described above, the first control signals (ΦB applied to the test mode signal generator 340 in FIGS. 3 to 5 include the writing enable signal WEB and the column and row address strobe signals CASB and RASB. In FIG. 7, circuits associated with generation of the PR, PC, PW, PROR and PCBR signals are omitted, but can be easily realized by those skilled in the art on the basis of the above description.

Figure 8:
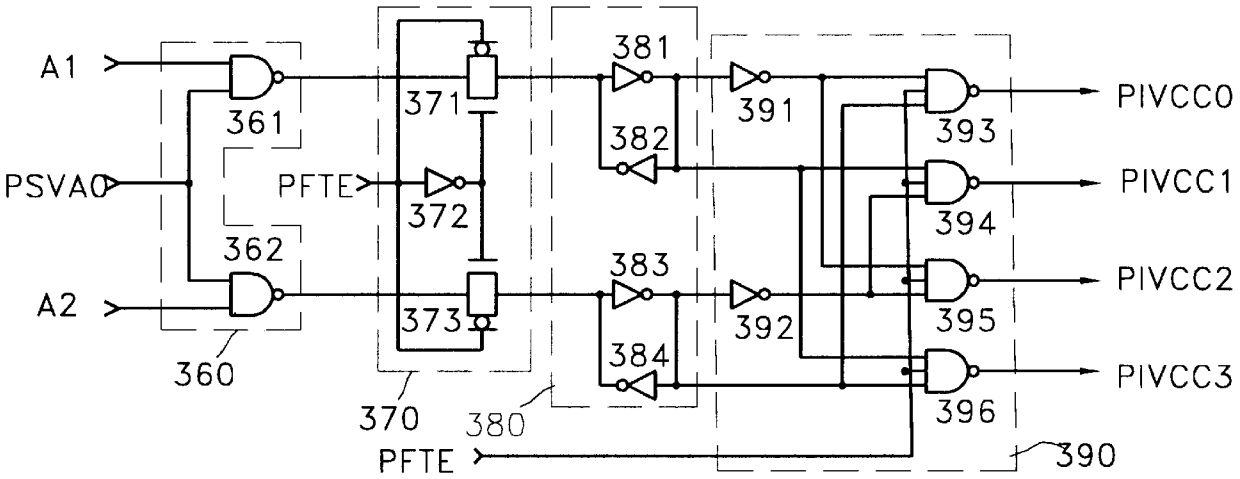
FIG. 8 is a circuit diagram of the switching signal generator shown in FIGS. 3 to 5.

FIG. 8 is a circuit diagram of an embodiment of the switching signal generator shown in FIGS. 3 to 5. The switching signal generator comprises an input portion 360, a transfer gate portion 370, a latch portion 380 and a decoding portion 390. The input portion 360 includes NAND gates 361 and 362, and inverts signals A1 and A2 applied through an address terminal from the outside of a chip when an input control signal PSVA0 has a high level. The transfer gate portion 370 includes an invertor 372 and two transfer gates 371 and 373, and transfers the output of the input portion 360 when the test mode signal PFFE has a low level. The output of the transfer gate portion 370 is latched by the latch portion 380 including invertors 381, 382, 383 and 384. Thus, the output of the latch portion 380 is consistently maintained while the test mode signal PFTE has a high level. The decoding portion comprised of invertors 391 and 392 and NAND gates 393, 394, 395 and 396 decodes the output of the latch portion and outputs switching signals PIVCC0, PIVCC1, PIVCC2 and PIVCC3 when the test mode signal PFTE has a high level, and outputs switching signals PIVCC0, PfVCC1, PIVCC2 and PIVCC3 having high levels when the test mode signal PFTE has a low level. Accordingly, in a test mode, the switching signals PIVCC0, PIVCC1, PIVCC2 and PIVCC3 are generated according to signals A0 and A1 applied from an external source. On the other hand, when it is not a test mode, the switching signals PIVCC0, PIVCC1, PIVCC2 and PIVCC3 are at a high level so that the PMOS transistors 513, 515, 522 and 524 included in each switching resistor portion shown in FIGS. 3 to 5 are all off. Thus, when it is not a test mode, the internal voltage conversion circuit provides an internal power supply voltage at a constant voltage level which is determined by the resistance value of PMOS transistors 512, 514, 521, 523 in FIG. 6.

Figure 9:
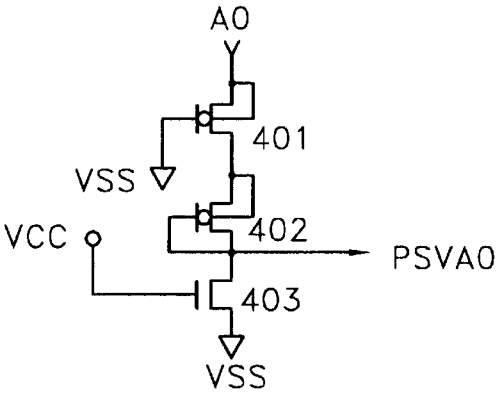
FIG. 9 is a circuit diagram of an input control signal generator for generating an input control signal (PSVA0) which is supplied to the switching signal generator shown in FIG. 8.

FIG. 9 is a detailed circuit diagram of an input control signal generator for generating an input control signal PSVA0 which is used in the switching signal generator shown in FIG. 8. The input control signal generator is comprised of two PMOS transistors 401 and 402 and an NMOS transistor 403. An internal power supply is connected to the gate of the NMOS transistor 403 to maintain NMOS transistor always in a conduction state. The gate of the PMOS transistor 401 is grounded, and a high voltage level signal applied from an external source in a test mode is applied to the source thereof.

According to the embodiments of the switching signal generator 330 shown in FIGS. 8 and 9, the second control signals (DA applied to the switching signal generator 330 shownin FIGS. 3 to 5 include signals A0, A1 and A2 which are applied to address input terminals 0, 1 and 2, respectively, of the DRAM.

FIG. 10 is a timing diagram which illustrates an operation of the internal voltage conversion circuit of the DRAM according to the present invention. A1 and A2 control the switching of each switching resistor portion, A0 is a signal for controlling whether or not the signals A1 and A2 are input, and RASB, CASB, WEB, which are applied from the outside of the DRAM, are signals for setting and releasing a test mode. As described above, PWCBR, PFTE and PIVCC0 to PIVCC3 are signals which are generated inside the DRAM to control the internal voltage conversion circuit on the basis of the signals applied from the outside of the DRAM. In a section T1, the test mode is set. In a section T2, a test is performed. In a section T3, the test mode is released.

Figure 11:
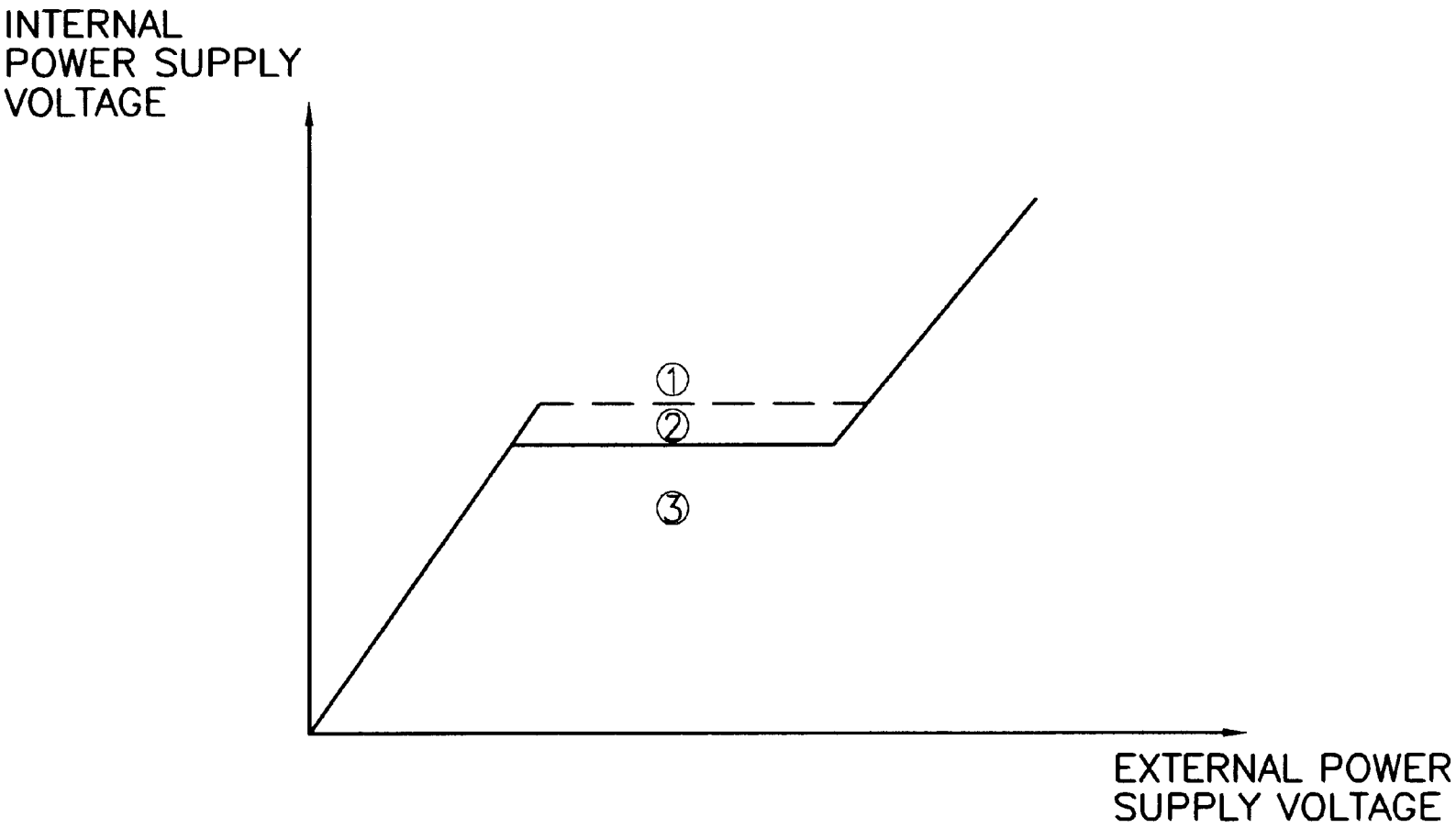
FIG. 11 is a graph illustrating an output characteristic of the internal voltage conversion circuit for a semiconductor device according to the present invention.

FIG. 11 is a graph showing an output characteristic of the internal voltage conversion circuit for a DRAM according to the present invention, which shows an output characteristic of a circuit in which resistor portions are structured as shown in FIG. 6. In FIG. 11, case 1 shows the internal power supply voltage as a function of the external power supply voltage when switching signals PIVCC2 and PIVCC3 are at a low level and the switching signal PIVCC0 or PIVCC1 is at a high level, case 2 shows the internal power supply voltage when switching signals PIVCC0, PIVCC1, PIVCC2 and PIVCC3 are at a high level, and case 3 shows the internal power supply voltage when the switching signal PIVCC2 or PIVCC3 is at a high level and the switching signals PIVCC0 and PIVCC1 are at a low level.

The present invention is not limited to the above embodiments, and it is apparent that various modifications may be effected by those skilled in the art within the spirit of the present invention.

Since the above-described internal voltage converting circuit for a semiconductor device can regulate the voltage level of an internal power supply depending on signals applied from the outside of a chip, it test the chip by applying different internal supply voltages responsive to signals applied to the chip pins after fabrication. Testing for chip defects is enhanced thereby increasing reliability of the product.

What is claimed is:

1. An internal voltage conversion circuit in a semiconductor device, said circuit comprising:

an internal power supply port through which an internal power supply voltage is output;

a comparator having a pair of input terminals and an output terminal;

a feedback line connected to one of said input terminals;

a reference voltage generator contained within the semiconductor device and having a reference voltage output terminal connected to the other of said comparator input terminals;

a transistor having a first port connected to a power supply voltage external to the semiconductor device, a control port connected to the output terminal of the comparator, and a second port;

a test mode signal generator for generating a test mode signal responsive to a first signal applied from the outside of the semiconductor device;

a switching signal generator for generating first and second switching signals responsive to second control signals applied from the outside of the semiconductor device when the test mode signal is active; and first and second switching resistor portions connected in series between said second port and a ground voltage, and switched by the first and second switching signals, respectively, so that their resistance values are changed, said feedback line being connected between the first and second switching resistor portions.

2. An internal voltage conversion circuit in a semiconductor device as claimed in claim 1, wherein said transistor is a PMOS transistor.

3. An internal voltage conversion circuit in a semiconductor device as claimed in claim 1, wherein the first switching resistor portion comprises at least one combinational transistor connected in series between said transistor's second port and the feedback line, each combinational transistor comprising:

a first transistor having a first port, a second port and a control port and being conducting when said circuit is in operative condition; and a second transistor having a first port, a second port and a control port, said control port being having one of the first switching signals applied thereto when said circuit is in operative condition, said second transistor first port being connected to the first port of the first transistor, and said second transistor second port being connected to the second port of said first transistor.

4. An internal voltage conversion circuit in a semiconductor device as claimed in claim 3, wherein the first transistor comprises a PMOS transistor having a grounded gate, and said second transistor comprises a PMOS transistor one of the first switching signals applied to the gate thereof when said circuit is inoperative condition.

5. An internal voltage conversion circuit in a semiconductor device as claimed in claim 1, wherein the second switching resistor portion comprises at least one combinational transistor connected in series between said feedback line and a grounded potential, each combinational transistor comprising:

a first transistor having a first port, a second port and a control port and being conducting when said circuit is in operative condition; and a second transistor having a first port, a second port and a control port, said control port being having one of the second switching signals applied thereto when said circuit is in operative condition, said second transistor first port being connected to the first port of the first transistor, and said second transistor second port being connected to the second port of said first transistor.

6. An internal voltage conversion circuit in a semiconductor device as claimed in claim 5, wherein the first transistor comprises a PMOS transistor having a grounded gate, and the second transistor comprises a PMOS transistor having one of the second switching signals to the gate thereof when said circuit is in operative condition.

7. An internal voltage conversion circuit in a semiconductor device as claimed in claim 1, wherein the switching signal generator comprises:

an input portion for receiving the second control signals in synchronization with a predetermined input control signal;

a transfer gate portion for transferring the output of the input portion when the test mode signal is active;

a latch portion for latching the output of the transfer gate portion; and a decoding portion for decoding the output of the latch portion and outputting the first and second switching signals.

8. An internal voltage conversion circuit in a semiconductor device as claimed in claim 7, further comprising an input control signal generator including:

an input control signal output terminal;

a first PMOS transistor having a source to which a high-voltage level signal applied from the outside in a test mode is applied when the circuit is placed into a test mode, and a ground voltage applied to the gate thereof;

a second PMOS transistor having a source connected to a drain of the first PMOS transistor and having a gate and drain commonly connected to the input control signal output terminal; and an NMOS transistor having a drain connected to the input control signal output terminal, a gate is connected to a power supply voltage terminal, and a source connected to a ground voltage terminal.

9. An internal power supply circuit in a semiconductor memory, said circuit comprising:

a comparator having a pair of input terminals and an output terminal;

means for generating a reference voltage, said generating means being operatively connected to a first one of said input terminals for applying said reference voltage thereto;

an internal power supply output terminal;

a transistor having a first side connected to a terminal external to said semiconductor memory for connection to an external power supply, a second side connected to said internal power supply output terminal, and a gate connected to said comparator output terminal;

a test mode signal generator having input terminals connected to first terminals external to said semiconductor memory for generating a test mode signal responsive to signals applied to said first terminals;

a switching signal generator having input terminals connected to second terminals external to said semiconductor memory for generating switching signals responsive to signals applied to said second terminals when said test mode signal is generated; and a variable resistor disposed in between said internal power supply output terminal and a second input terminal of said comparator, said resistor being operatively connected to said switching signal generator, said resistor varying in resistance responsive to said switching signals.

10. The circuit of claim 9 wherein said variable resistor comprises transistors connected in series and wherein said switching signals are applied to the gates thereof when said circuit is in operative condition.

11. The circuit of claim 9 wherein said circuit further comprises means for latching said switching signals.

12. The circuit of claim 11 wherein said circuit further includes an input control signal generator having an input terminal connected to a terminal external to said semiconductor memory and an output terminal connected to said switching signal generator, said switching signals being supplied to variable resistor responsive to a signal applied to the input terminal of said input control signal generator.

* * * * *

UNITED STATES PATENT AND TRADEMARK OFFICE

CERTIFICATE OF CORRECTION

PATENT NO. : 5,929,696
DATED : July 27, 1999
INVENTOR(S) : Lim et al.

It is certified that error appears in the above-identified patent and that said Letters Patent is hereby corrected as shown below:

Column 1,
Line 32, “comparator 10” should read -- comparator 110 --.

Column 6,
Line 60, “PFFE” should read -- PFTE --.

Column 7,
Line 55, “PFFE” should read -- PFTE --.
Line 65, “PfVCC1 should read -- PIVCC1 --.

Column 8,
Line 25, “DA” should read -- ΦA --.

Column 9,
Line 56, “inoperative condition” should read -- in operative condition --.

Signed and Sealed this

Twentieth Day of August, 2002

*Attest:*

*Attesting Officer*

JAMES E. ROGAN
*Director of the United States Patent and Trademark Office*